US006920817B2

(12) United States Patent
Ravid et al.

(10) Patent No.: US 6,920,817 B2
(45) Date of Patent: Jul. 26, 2005

(54) COMPOSITE ARMOR STRUCTURE

(75) Inventors: Moshe Ravid, Hod Hasharon (IL); Yoav Hirschberg, Marom Hagalil (IL)

(73) Assignee: Plasan-Kubbutz Sasa, M.P. Marom Hagalil (IL)

( * ) Notice: Subject to any disclaimer, the term of this patent is extended or adjusted under 35 U.S.C. 154(b) by 0 days.

(21) Appl. No.: 10/388,759

(22) Filed: Mar. 17, 2003

(65) Prior Publication Data

US 2004/0020354 A1 Feb. 5, 2004

(30) Foreign Application Priority Data

May 6, 2002 (IL) ..... 149479

(51) Int. Cl.[7] ..... F41H 7/00; F41H 5/013; F41H 5/02; B64D 7/00

(52) U.S. Cl. ..... 89/36.11; 89/36.02; 89/36.04

(58) Field of Search ..... 89/36.02, 36.04, 89/36.07, 36.11; 428/911; 109/49.5

(56) References Cited

U.S. PATENT DOCUMENTS 3,683,828 A 8/1972 Alliegro et al. ..... 109/83
4,757,742 A * 7/1988 Mazelsky ..... 89/36.02
5,670,734 A * 9/1997 Middione et al. ..... 89/36.08
6,009,789 A 1/2000 Lyons ..... 89/36.02
6,332,390 B1 12/2001 Lyons ..... 89/36.02

FOREIGN PATENT DOCUMENTS

DE 31 49 782 A1 8/1983
DE 31 22 367 C1 12/1994
DE 40 17 167 C1 1/1998
EP 611 943 A1 * 8/1994 ..... 89/36.02

* cited by examiner

*Primary Examiner*—Stephen M. Johnson
(74) *Attorney, Agent, or Firm*—Nath & Associates PLLC; Gregory B. Kang; Derek Richmond

(57) ABSTRACT

A composite armor structure for ballistically protecting a gap from an impacting projectile threat and for use with at least one ballistic armor module. The gap extends along a margin of the module. The structure comprises a body having a protection portion with at least a single layer of ceramic bodies. The structure further comprises a carrier portion supporting the protection portion and being made of a material different from the ceramic bodies. The protection portion is designed to span the gap. The carrier portion is designed to extend beyond the gap to overlap with the margin when viewed from a perspective of the impacting projectile threat.

21 Claims, 2 Drawing Sheets

COMPOSITE ARMOR STRUCTURE

FIELD OF THE INVENTION

This invention relates to ballistic protection provided by armor modules, and, in particular, to means for protecting the gaps between and around these modules.

BACKGROUND OF THE INVENTION

In composite ballistic armor plates composed of ceramic tiles, it is known to protect gaps between the tiles to improve the ballistic protection of such plates. It is also known to protect the regions near the gaps, which include edges and corners of tiles as well as the boundaries (also known as joints in the art) between them.

U.S. Pat. No. 3,683,828 discloses ceramic composite armor comprising an outer layer of ceramic tiles and an underlying layer of laminate fibrous backing. The armor further includes strips of carbon steels, alloy steels, or titanium placed directly under the free edges and joints of the tiles to improve the performance of the armor. These metallic strips, which are set along the entire length of the free edges and joints, are bonded with an adhesive between the layer of tiles and the backing.

U.S. Pat. No. 6,009,789 and U.S. Pat. No. 6,332,390 disclose ceramic armor made of tiles and comprising a substrate laminate layer. The armor further includes glass or ceramic overlay strips bonded with an adhesive to the joints and free edges of the tiles in order to reinforce and protect these regions from a ballistic threat.

SUMMARY OF THE INVENTION

The present invention suggests a composite armor structure for use with at least one ballistic armor module for ballistically protecting a gap from an impacting projectile threat, where the gap extends along a margin of the module. The structure comprises a body having a protection portion with at least a single layer of ceramic bodies, and a carrier portion supporting said protection portion and being made of a material different from said ceramic bodies. Said protection portion is designed to span the gap and said carrier portion is designed to extend beyond the gap to overlap with said margin, when viewed from a perspective of the impacting projectile threat.

The protection portion of the structure according to the present invention functions as a ceramic core adapted to absorb and dissipate kinetic energy from an impacting projectile and, in this way, to provide ballistic protection over the gap, which may exist around and/or between ballistic armor modules. To this end, the protection portion covers at least the majority of the area of the gap exposed to ballistic attack, and preferably extends beyond this area to margin(s) of the adjacent module(s) and possibly areas close thereto, which may have relatively reduced ballistic effectiveness. In other words, the protection portion preferably bridges between the more ballistically effective areas of the modules, closing gaps therebetween.

Depending on the design of the ballistic modules and, especially, on the shape and sizes of the gaps therebetween, the composite armor structure of the present invention may be of corresponding various shapes and sizes. With normal shapes of the gap, the structure is preferably longitudinal, such as in the form of a strip, so that it may extend to span the gap. The structure may also be annular or at least partially curved so it may be better suited to various module designs, such as to be compatible with gaps of circular or otherwise curved modules, as well as with gaps between convexly curved modules directed to ballistically protect curved, as well as flat, surfaces.

The composite armor structure according to the present invention is particularly suitable for use in ballistic armor made up of a plurality of modules. The structure is directed to provide protection from expected impacting projectile threats, to gaps existing between and around margins of the modules and, possibly, to reinforce areas of these modules along the margins. To enable this, the composite armor structure according to the present invention is preferably manufactured and employed as a network whose body comprises a plurality of integrally formed protection strips each having said protection and carrier portions. The network may be designed to protect all the gaps between and around a plurality of modules in a specified area whose full ballistic protection is desired. This is preferably achieved by assembling the network from sections, which may be easily attached or removed one at a time according to the desired coverage of ballistic protection for the specified area, thereby rendering the network with convenient modularity.

The composite armor structure of the present invention is particularly useful to protect the gaps between and around modules used with a wide variety of military and civilian vehicles, including ground, water, air and space transports. It is also suited for use in individual (personnel) body armor.

In military choppers, for example, the floor is often protected by armor modules which may have a variety of sizes and shapes suited to the arrangement of different appliances located on the floor, such as pilot and passenger seats. In order to protect the gaps between the modules, the composite armor structure of the present invention may be attached to the modules, preferably from beneath, to span the gaps and to ballistically bridge between adjacent modules.

The composite armor structure of the present invention may be produced in several ways, mainly from several layers of material. For the structure in the form of a strip, for example, three strip layers may be used: two thin solid top and bottom layers and one thick intermediate layer with a cut-out having dimensions corresponding to those of the protection portion. A cavity defined by the bottom layer and the walls of the cut-out in the intermediate layer is filled with a plurality of ceramic bodies and sealed by the top layer. The cavity filled with the ceramic bodies thus constitutes said protection portion of the strip and the remainder of the strip surrounding the cavity constitutes the carrier portion. The structure in the form of a network may be produced similarly, from three sheet layers, where the intermediate layer has a plurality of cut-outs corresponding to different gaps between different modules and defining a plurality of protection portions, which constitute protective cores for the network. The three sheet layers may further be provided with additional cut-outs corresponding to the modules, to reduce the weight of the structure, leaving only a construction made up of a plurality of strips portions. In this case, the carrier portions of different strips may be connected to one another by integrally formed support members in the form of extensions of the carrier portions, which are free of ceramic bodies, to cross over the modules and hold the network together as a unitary construction.

The composite armor structure according to the present invention may is have a variety of designs and may be produced in various ways. For example, the structure may be produced from two layers of material, with the first layer having a central depression, which serves as an open-top cavity to be filled with and to carry the ceramic bodies. The other layer serves to cover the first layer to keep the bodies in place.

The ceramic bodies of the protection portion of the structure according to the present invention may be made of any known ceramic capable of providing effective ballistic protection such as Alumina ($Al_2O_3$), Silicon Carbide (SiC), Silicon Nitride ($Si_3N_4$), and Boron Carbide ($B_4C$). Ceramic glass and ceramic matrixes containing reinforcing fibers, for example, may also be used.

The carrier portion of the composite armor structure according to the present invention may have any form so long as it provides support to the protection portion by extending along and laterally away from the protection portion to overlap with the margins of the modules when seen from the perspective of an approaching projectile threat.

The composite armor structure according to the present invention may thus be made lightweight both due to the materials used and due to its design that is free of any superfluous areas, since it includes only protection cores surrounded by their carrier portions. The composite armor structure according to the present invention, when in the form of an easily attachable network, may also be relatively simple to manufacture, especially when compared with other possible ways of protecting a plurality of gaps between large-scale ballistic armor modules.

In applications where the modules are directly attached to a surface to be ballistically protected, the network may also advantageously serve to space the modules from the surface by attaching the network to this surface first, and attaching the modules to it thereafter. Since the modules generally protect a majority of the surface, distancing them from the surface increases the likelihood that the projectile threat will be stopped when it impacts the modules after it pierces the surface but at some distance therefrom, significantly reducing damage that would ordinarily be caused to the surface if the modules were attached to the surface in direct contact.

The structure according to the present invention is particularly advantageous in that it is not only adapted to protect the gaps between modules, but may also directly contact and overlap with the modules to reinforce the normally reduced ballistic protection provided by the margins (known as an "edge effect") of the modules.

Since the present invention may be applied to a variety of ballistic armor constructions, the term 'modules', as used in the present description and claims, should be understood to refer to any armor members having at least one gap between them. The modules may be of any design and scale such as that of plates, tiles and the like of various shapes and sizes. The modules may also be made from any known material such as various types of metals, armor ceramics, and glass.

The present invention further suggests a ballistic armor assembly for providing protection to a surface from an impacting projectile threat, the assembly comprising at least one ballistic armor module for the protection of a major area of the surface and a gap adjacent the module's margin, and further comprising at least one composite armor structure as described above for ballistically protecting said gap from the impacting projectile threat.

In the ballistic armor assembly of the present invention, the module or modules and the gap protecting structure preferably further comprise a common backing layer, as is known in the art, for trapping fragments of the modules, the structure, and the projectile resulting from the projectile's impact. The backing layer is typically made of woven fabrics such as Spectral, Dyneema®, Twaron®, and Kevlar™ but any other suitable material, such as glass fibers or Aluminum, may also be used. The backing layer may be attached directly to the assembly or may be somewhat spaced therefrom. It may be attached using any means of attachment such as adhesives or hook and loop fasteners such as Velcro™, for example. The backing layer may be in the form of a carpet to cover the assembly when used to ballistically protect a vehicle floor.

When used in the form of a network having a common backing layer and attached with ballistically resistant attachment means, the composite armor structure of the ballistic armor assembly according to the present invention allows for the achievement of essentially 100% protection over the area covered by the surface to be protected, regardless of how large the area.

The ballistic armor assembly of the present invention may further comprise additional layers to enhance its ballistic performance. For example, in producing the composite armor structure of the present invention, a relatively thin layer of reinforcing fibers may be added between the intermediate layer and the top layer and/or bottom layer to facilitate bonding of the layers together, to ensure a stable confinement of the protection portion, and to increase the ballistic protection provided by the structure. Also, the assembly may further comprise a spall shield, for example, to cover the assembly and minimize the likelihood of outward deflection of the impacting projectile threat and to minimize ejection of fragments resulting from said threat.

The present invention further provides for ballistically protected means of attaching the module to the composite armor structure of the present invention, as well as for attaching the latter to the surface to be protected, thereby providing protection even at the attachment areas and the regions thereabout. Alternatively, attachment of the module to the structure and attachment to said surface may be made at one location by a single ballistically protected fastening member.

In particular, the present invention further suggests a composite armor construction for ballistically protecting a gap from an impacting projectile threat and for use with at least one ballistic armor module having a module through bore to freely receive a fastening member for the attachment of said module to a surface to be protected, the gap extending between margins of said module through bore and said fastening member, the construction comprising a gap-protecting body having a protection portion in the form of a rigid insert made of ballistically resistant material, and a carrier portion supporting said protection portion and being made of a material different from said ballistically resistant material, said rigid insert being designed to span the gap and having an insert bore adapted to tightly receive said fastening member, said carrier portion being designed to extend beyond the gap to overlap with said margins, when viewed from a perspective of the impacting projectile threat made of a ballistically resistant material.

The carrier portion of the construction according to the present invention is similar to the carrier portion described above for the structure of the present invention. The carrier portion is preferably adapted to provide at least lateral support to said protection portion by being located on at least two sides thereof. The carrier portion is preferably made from a metal such as alloys of Aluminum, Steel, and Titanium, but may also be made from other materials such as fiberglass, carbon fibers, Nylon, high strength plastic, and Kevlar™. In addition, the carrier portion further comprises attachment means, such as fixation bores, for attaching the construction to said surface.

The protection portion of the construction of the present invention plays a role parallel to the protection portion of the structure of the present invention described above as it is designed to cover at least a majority of an area of said gap exposed to said impacting projectile threat, and preferably extends beyond said area to overlap with the margins of the module through bore, particularly to provide said margins with ballistic reinforcement. The protection portion is made from a ballistically resistant material having a minimum hardness of 45 Rc. Examples include Steel 4140, or Steel 4340 quenched and tempered to the requisite hardness.

The composite armor construction according to the present invention may be made in the form of a network designed to simultaneously protect a plurality of gaps. The network includes a plurality of protection portions, each surrounded by its corresponding carrier portion with different carrier portions being interconnected. Preferably, the protection portions are each in the form of an insert to be inserted in its corresponding carrier portion from beneath. In addition, the protection portion preferably includes a boss portion protruding outwardly from said construction and adapted to be received within said module through hole to facilitate attachment of said module to said construction. According to the present invention, the fastening element is preferably a screw and said insert bore includes a thread therein to tightly receive said screw, which is adapted to attach said module to said construction. The insert bore may extend throughout the boss portion and even fully through the entire length of the protection portion, enabling the fastening element to also attach said construction to said surface at a single location.

The construction according to the present invention is preferably adapted to be used in a transport vehicle, such as for protecting the gaps in the attachment means in modules protecting a chopper floor. The construction may be provided with a cut-out corresponding to said module to reduce its weight.

The present invention further provides for a ballistic armor arrangement for providing protection to a surface from an impacting projectile threat, the arrangement comprising at least one ballistic armor module for the protection of a major area of the body, the module having a module through bore to freely receive a first fastening member for the attachment of said module to said surface to be protected, the arrangement further comprising at least one composite armor construction for ballistically protecting a gap, which extends between margins of said module through bore and said fastening member, from the impacting projectile threat, as defined in above.

The arrangement according to the present invention may further comprises a second fastening member adapted to attach said module to said construction, or alternatively, the first fastening member is further adapted to attach said module and said construction to said surface.

The arrangement of the present invention preferably further comprises a receiving member adapted to be disposed within the module through bore, the receiving member comprising a female element with an open lower end designed to receive the boss portion of said protection portion, and a male element adapted to mate with said female element and having an open upper end, said male element and said boss portion being designed to receive said fastening member.

To enhance ballistic protection provided thereby, the arrangement according to the present invention preferably also includes a backing layer for trapping fragments resulting from the impacting projectile threat.

In addition, the present invention suggests a ballistic armor attachment kit for protectively securing a ballistic armor module to a composite armor construction in an arrangement as defined above, the kit comprising a rigid insert and a receiving member both as defined above.

The ballistic armor assembly attachment kit according to the present invention allows for greater freedom in attachment of the modules to a network, since they may be placed virtually anywhere on the network and no longer need to coincide with the existing attachment means of the surface to be protected, as is typically the case. Since at least the ballistic inserts of the kit are be made of a ballistically resistant material and have a ballistically resistant design as may the other components of the kit, the attachment of the composite armor structure of the present invention to modular armor using the kit of the present invention could effectively provide practically total, invulnerable protection from ballistic attack.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF THE INVENTION

Figure 1:
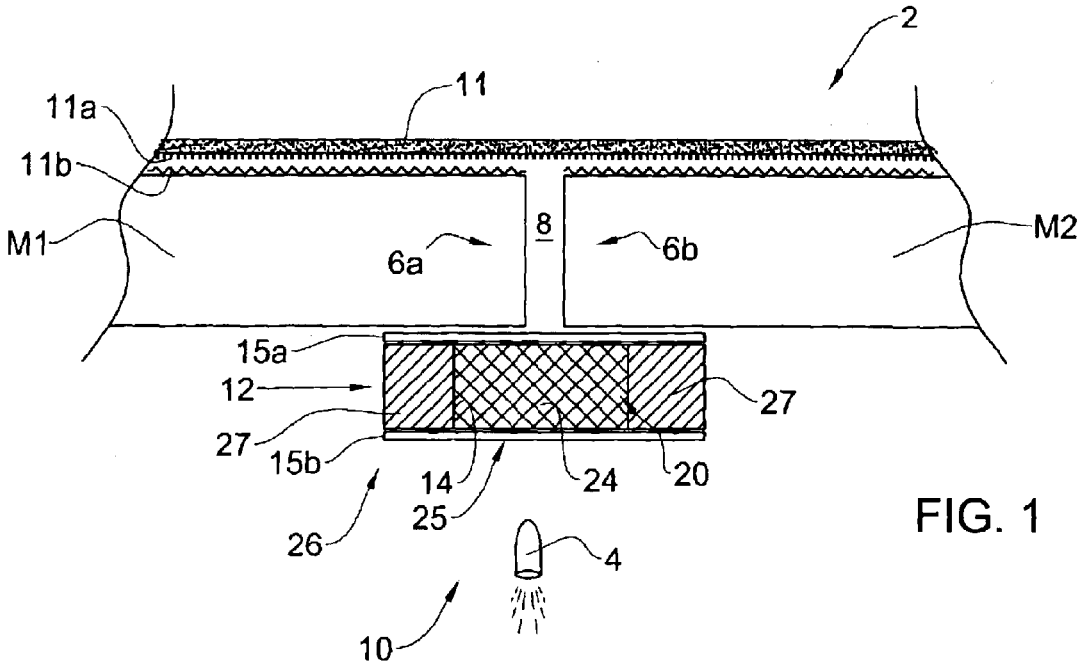
FIG. 1 schematically shows a cross-section of a ballistic armor assembly with a composite armor structure in accordance with the present invention.

FIG. 1, which is not drawn to scale and is provided for the purpose of illustration, schematically shows a cross-section of a ballistic armor assembly 2 according to the present invention for providing protection to a cabin floor of a military chopper (not shown) from an impacting projectile threat 4 approaching the cabin.

The ballistic armor assembly 2 comprises two modules M1 and M2 having margins 6*a* and 6*b* with a gap 8 therebetween. Attached between the modules M1 and M2 and beneath the gap 8 is a composite armor structure in the form of an elongated strip 10 according to the present invention, adapted to provide the gap 8 with ballistic protection from the impacting ballistic threat 4. The assembly further comprises a backing layer in the form of a ballistic carpet 11.

The strip 10 is in the form of a multi-layered body and it comprises a relatively thick intermediate layer 12 with a through cut-out 14, sandwiched between two relatively thin layers 15*a* and 15*b*, whereby a cavity 20 is formed.

The cavity 20 is filled with a plurality of ceramic bodies 24 and constitutes a protection portion 25 of the strip 10. The ceramic bodies 24 are preferably in the form of longitudinal tiles (not shown) arranged in a single layer along the bottom of the cavity 20. The tiles may be arranged in one column extending along the length of the cavity with one or more tile in a row. The ceramic bodies 24 may have any design and may be arranged in any manner so long as they retain the capability of protecting from an expected ballistic threat. Examples of possible designs include tiles and pellets having a wide variety of shapes, such as cylindrical, spherical, or hexagonal. Though it is preferable that the ceramic bodies are arranged in the cavity 20 in one layer, they may be arranged in multiple layers. The bodies may be arranged in a layer according to a regular pattern or randomly. The bodies may also be bound together by a binding material or adhesive, such as epoxy, polyurethane thermoset, as well as thermoplastic resins. These and other such possibilities for the ceramic bodies are known in the art.

The thickness of the intermediate layer 12 equals to the thickness of the layer of the ceramic bodies 24, which in turn depends on the ballistic threat against which the protection needs to be obtained. The layers 15*a* and 15*b* may be much thinner than the layer 12 since their sole function is to seal the cavity 20. The layers may be made of any suitable material capable of supporting the protection portion and should preferably be inexpensive, lightweight, and easily machined or otherwise processed. Such materials include, for example, alloys of Aluminum, Steel, and Titanium, and composite materials such as Carbon fibers, Fiberglass, Nylon, Kevlar™, high strength plastics and the like.

The dimensions of the cavity 20 and, consequently, of the protection portion 25 of the strip, when viewed from the perspective of the ballistic threat 4, preferably exceed those of the gap 8, both along the length of the gap (not seen in FIG. 1) and along its transverse direction. In particular, as seen in FIG. 1, the protection portion 25 overlaps with the margins 6*a* and 6*b* of the modules M1 and M2. However, this does not necessarily need to be the case, and the protection portion 25 may have dimensions equal or even slightly less than the corresponding dimensions of the gap, depending on the desired extent of ballistic protection.

The remainder of the strip 10 that surrounds the protection portion 25 and is free of ceramic bodies 24, constitutes a carrier portion 26 of the strip, which serves to provide the protection portion 25 with support and to enable the strip 10 to be mounted by means of lateral regions 27 thereof without involvement of the protection portion in the mounting.

The strip 10 may be produced in the following way: the cut-out 14 is first made in the layer 12 and the layer 12 is glued to the layer 15*b* to define the cavity 20. The cavity 20 is then filled with the ceramic bodies 24 and the layer 15*a* is glued thereon to seal the bodies in the cavity.

In operation, the strip 10 according to the present invention dissipates and absorbs kinetic energy from the projectile threat impacting thereupon and prevents its penetration through the gap 8 between the modules M1 and M2, thereby protecting the cabin of the chopper. Since the strip 10 also overlaps to some extent with the modules M1 and M2, it provides further protection to the cabin by structurally reinforcing the margins 6*a* and 6*b*, which typically have a reduced ballistic performance in comparison to regions of the modules M1 and M2, such as their centers, located farther from the gap 8. The ballistic carpet 11 serves to prevent the penetration of fragments of the projectile, the modules M1 and M2 and from the strip 10 that may be expelled as a result of the projectile's impact.

The required dimensions of the strip 10 and more particularly, of the protection portion 25, yielding the optimal ballistic performance of the strip 10, are determined based on the expected projectile threat 4 and dimensions of the gap 8. The following parameters for the strip 10 shown in FIG. 1 may, for example, be used for protecting from the threat of a Dragunov 7.62×54 R mm API (BZ) projectile striking at 870 m/s at normal impact:

Dimensions of gap: 2–5 mm wide (distance between modules);

Dimensions of strip: 45 mm wide and 12 mm high (from layer 15*a* to 15*b*);

Dimensions of protection portion: 25 mm wide and 10 mm high;

Characteristics of ceramic bodies: a single layer of 98% $Al_2O_3$ rectangular tiles, each tile being 25 mm×50 mm×10 mm;

Material and dimensions of the three layers (12, 15*a* and 15*b*): All made from Al 7075T651 and attached to each other by adhesive material; layer 12 is 10 mm high and layers 15*a* and 15*b* are 0.5 mm high;

Type of backing layer: a carpet formed of 7 layers of Aramid Type 713 by Dupont™ laminated with 37 g/m$^2$ of Nylon resin between the layers. The carpet is rubber coated to reduce wear and tear, as well as in order to prevent slipping.

Figure 2:
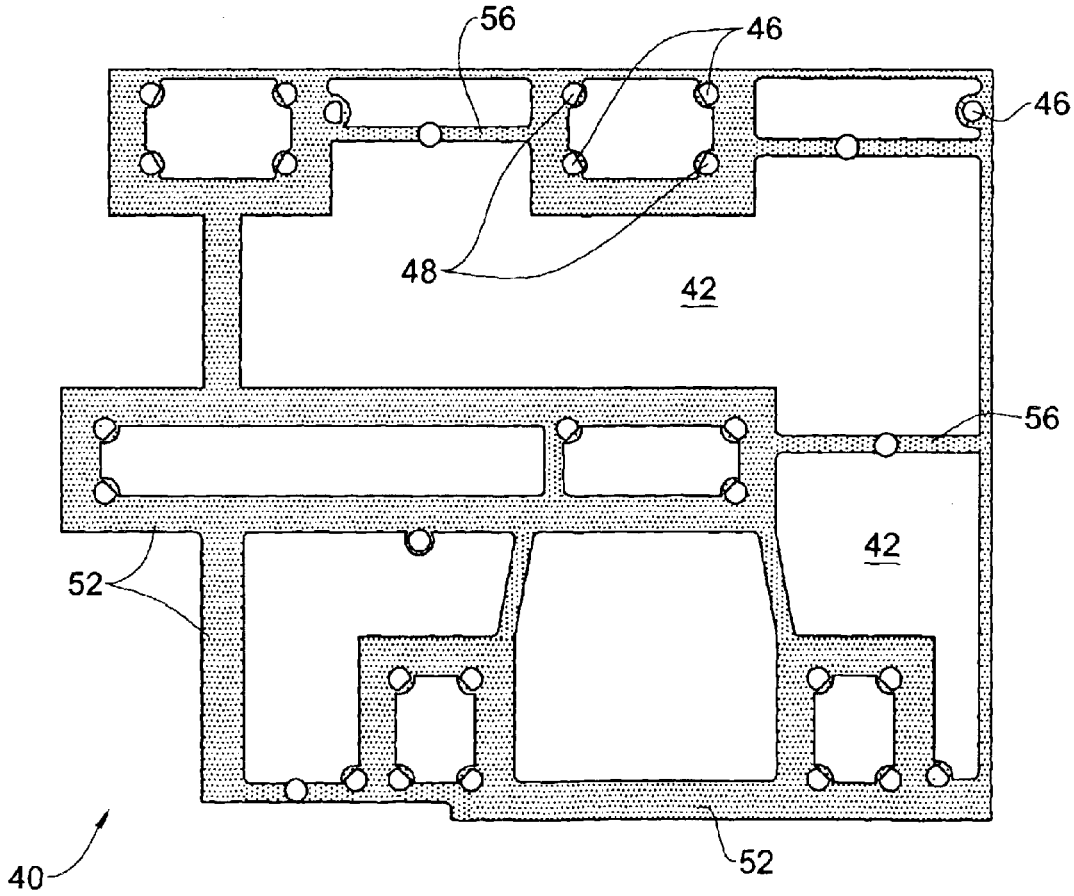
FIG. 2 schematically shows a planar view of the composite armor structure in accordance with the present invention in the form of a network from a perspective of an impacting projectile threat.

A ballistic armor structure according to the present invention in the form of a network 40 is schematically shown in FIG. 2. The network 40 is designed to protect gaps between and around a plurality of ballistic armor modules disposed on a chopper floor, and it is shown in FIG. 2 as viewed from a perspective of an impacting projectile threat, before ballistic modules have been mounted thereto. Such modules on a chopper are adapted for use with various appliances, such as passenger seats, auxiliary fuel tanks, lift bases, gun bases, and the like, which are disposed on the floor of the chopper, to protect these appliances from projectile threats particularly originating from below the chopper when it is in flight. These modules are typically attached to the floor of the chopper by screws and bolts.

The network 40 is in the form of a unitary body with a plurality of integrally formed strip portions 52, each similar in appearance and function to the strip 10 described above, and having a cross-section as shown in FIG. 1 with respect to the strip 10. Consequently, the network 40 has a plurality of protection portions each having its carrier portion, the carrier portions of different strip portions 52 being interconnected.

In order to form a stable and unitary construction, the network 40 further comprises support members 56, which are formed as extensions of the carrier portions of some strip portions 52, and are consequently free of ceramic bodies. The network further includes spaces 42, which correspond to areas that are to be protected by the plurality of modules on the chopper floor. The support members 56 pass over the spaces 42 to connect the strip portions 52.

Thus, as clearly follows from the above, the design of the network 40 correlates to the floor plan of the chopper, with the spaces 42 being slightly smaller than the corresponding modules and the strip portions 52 being slightly larger than the corresponding gaps so that they overlap with the modules when installed in a chopper.

As an example, the network 40 according to the present invention as shown in FIG. 2 may be produced by providing two thin sheets corresponding in dimensions to the entire floor and serving as covering layers similar to layers ISa and 15*b* shown in FIG. 1. Next, a thicker sheet corresponding in dimensions to the entire floor is provided to serve as a layer similar to the intermediate layer 12 shown in FIG. 1. Using known methods, such as mechanically or by the use of a laser or water jet, areas of all the sheets corresponding to the location of the modules on the floor are cut out to form the spaces 42, constituting a primary cutting design for the network 40. Cut-outs are also provided in the thicker sheet to house a plurality of protection portions similar to the protection portion 25, to protect the plurality of gaps as known from the floor plan, constituting a secondary cutting design.

The thicker sheet is aligned and attached to one of the thin sheets using an adhesive, such as epoxy, polyurethane thermoset, or thermoplastic resin. A plurality of cavities similar to the cavity 20 is thus formed in the areas where the cut-outs of the secondary cutting design were made and these cavities are filled with ceramic bodies 24 to form the protection portions. The remaining thin sheet is placed over the other two glued sheets in alignment and attached thereto by an adhesive, thereby sealing the protection portions in place.

Clearly, the network of strips may be made in other ways and using various technologies, which a person skilled in the art would find appropriate. For example, it may be preferable for the network 40 to be produced in sections and consequently assembled or disassembled one section at a time in order to render the network with convenient modularity. These sections may be easily attached to the floor and/or to one another or removed therefrom to form as much of a network protecting the entire chopper floor as necessary according to the desired extent and configuration of ballistic protection.

During the manufacturing of the network 40, the lateral regions 27 of the carrier portions of the strip portions 52 and the support members 56 may be provided with attachment means such as fixation bores for the attachment of the network 40 to the floor of the chopper and/or to the modules (not shown). Preferably, two kinds of fixation bores are provided in the network 40, with first fixation bores 46 adapted to overlap with attachment bores that are a standard part of the construction of the chopper floor, and second fixation bores 48 adapted for attachment of the modules, via their own fixation bores, to the network 40.

Figure 3:
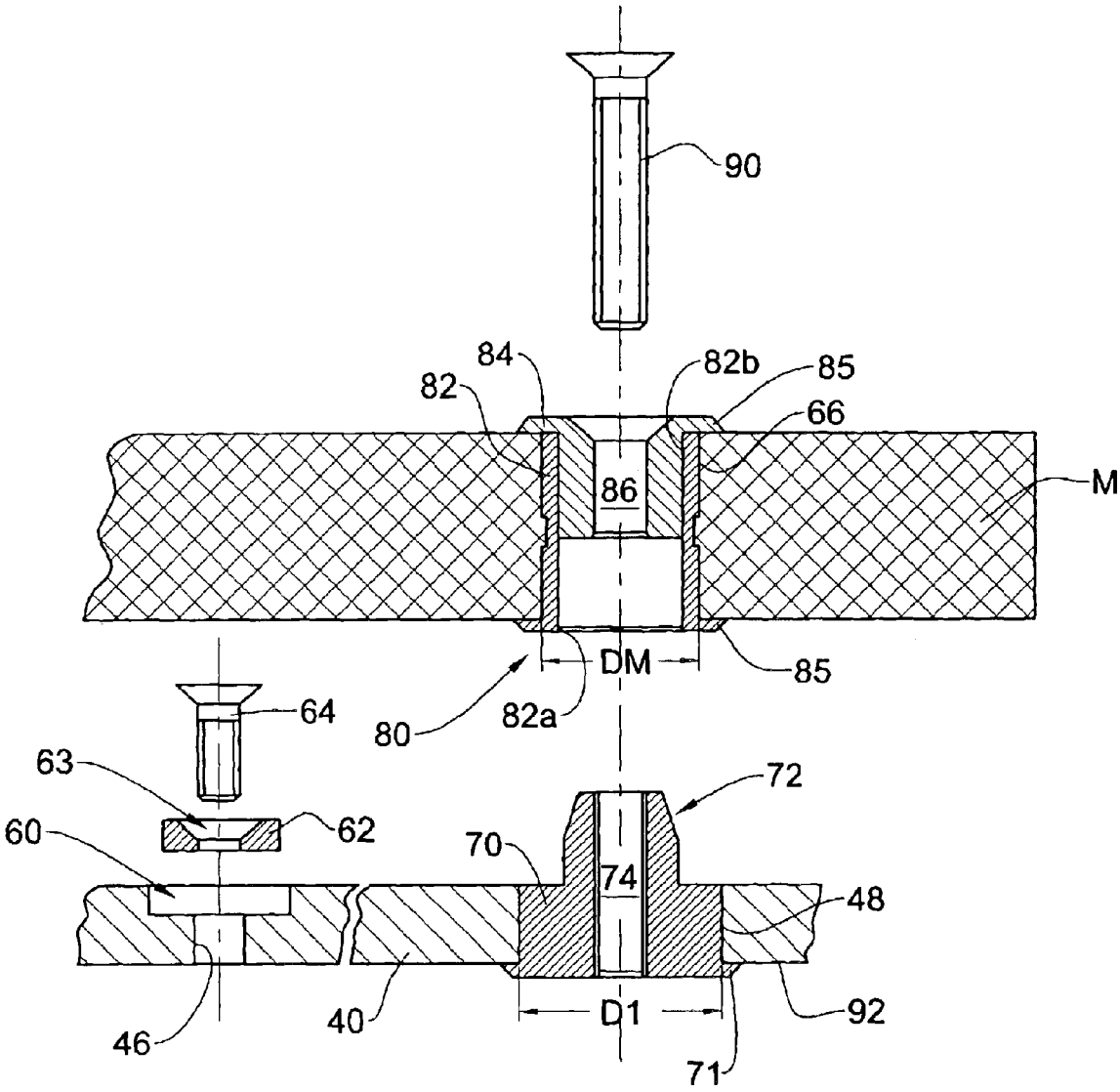
FIG. 3 schematically shows a cross-section of a ballistic armor arrangement with a composite armor construction and ballistic armor attachment kit in accordance with the present invention.

FIG. 3 schematically shows a section of a ballistic armor arrangement according to the present invention, which includes the network 40 of the present invention and a standard ballistic armor module M designed for attachment to a chopper floor (not shown). The network 40 comprises first fixation bore 46 and second fixation bore 48. The first fixation bore 46 includes a wide indentation 60 in the surface facing the module M, for receiving a disk 62, which is made of stainless steel 303 or 304 and has an aperture for receiving a first small screw 64. The disk 62 and the first, small screw 64, which may, for example, be 3/16 inch in diameter, serve as means for attachment of the network 40 to the chopper floor.

The module M comprises a module fixation bore 66 with diameter DM and the second fixation bore 48 of the network 40 has a diameter D1 which is greater than DM.

FIG. 3 further shows a ballistic armor attachment kit in accordance with the present invention for protectively securing the module M to the network 40 by means of the module fixation bore 46 and the network's second fixation bore 48. The kit includes a ballistic insert 70 disposed within the second fixation bore 48 of the network 40 and spanning its entire diameter D1. The insert 70 is attached in place under pressure by an adhesive. The insert 70 also includes insert grasping rims 71 to ensure that it maintains its position within the bore 48. The ballistic insert 70 is made of quenched and tempered Steel 4140 having a hardness of 52 Rc, capable of providing protection from a projectile impacting thereupon. The insert 70 includes a tapering, substantially frusto-conical boss portion 72 projecting above the network 40 towards the module M. The insert 70 includes a threaded bore 74 running through the boss portion 72 and preferably, spanning the vertical length of the insert 70.

A receiving member 80 is disposed within the module fixation bore 66. The receiving member 80 comprises a mostly hollow female element 82 having an outer diameter corresponding to DM and an inner diameter slightly greater than that of the boss portion 72 so as to receive the boss portion at lower end 82*a* of the female element. The receiving member 80 further includes a male element 84 mating with the female element 82 and received therein at upper end 82*b* of the female element. The male element 84 only partially extends into the female element and includes a through bore 86 creating a passage within the receiving member 80. The female and male elements 82 and 84 also comprise module grasping rims 85 to ensure that they maintain their position within the bore 66. A second, large screw 90, which may, for example, be 1/4 inch in diameter and which is considerably longer than the first, small screw 64, serves to attach the module M to the network 40, being adapted to threadingly engage the threaded bore 74 of the insert 70.

Attachment of the arrangement according to the present invention begins with tight insertion of all the ballistic inserts 70 into the second fixation bores 48 of the network 40 from below the network, with the network grasping rims 71 ensuring that the inserts 70 enter completely into the bores 48 but not beyond bottom surface 92 of the network 40. The network 40 is set down on the chopper floor so that the first fixation bores 46 of the network are aligned with the standard attachment holes in the floor. The first fixation bores 46 are large enough to accommodate the large majority of screw and fixation hole diameters. Disks 62 having screw bores 63 are placed within the indentations 60, which have a corresponding shape to provide the disks 62 with support, and first screws 64 are inserted through the screw bores 63 of the disks 62 and the first fixation bore 46, and are threaded into the overlapping holes in the chopper floor. With the screw bore 63 being specifically designed to tightly receive first screw 64, the disk 62 serves as an adapter that suits the screw 64 to the first fixation bore 46. The disk 62 also serves to keep the first screw 64 from directly contacting the relatively soft material of the network 40, which would result in repeated abrasion and would damage the assembly.

Before their attachment to the network 40, the modules are fitted with receiving members 80 in all of the module fixation bores 66. This is done by tightly inserting the female elements 82 into the module fixation bores 66 from below each module and attaching them under pressure with adhesive. Subsequently, the male elements 84 are tightly inserted from above the modules through the module fixation bores 66 and into the female elements 82. The male and female elements 84 and 82 are preferably also attached by placing them under pressure and gluing them together with an adhesive. In addition, the module grasping rims 85 ensure that the receiving members 80 remain fixed in place with the fixation bores 66. The modules are then placed on the network 40, with the receiving members 80 being aligned with the ballistic inserts 70 to allow the boss potions 72 to enter therein from below. The first fixation bores 46 become sealed and further secured as the modules cover the first screws 64. The inserted boss portions 72 prevent the modules from displacing horizontally and the larger diameter D1 of the ballistic inserts 70 in comparison to the diameter of the module fixation bores 66 within which they sit, allows for reinforcement of the reduced ballistic effectiveness of the modules around the margins of the bores 66. Finally, the second, large screws 90 are inserted via the through bores 86 of the male elements 84 of the receiving members 80, and threaded into the threaded bores 74 of the ballistic inserts 70, thereby securing the modules to the network 40.

During production of the modules, each of which is typically made up of a plurality of ceramic tiles, it is preferable that the module fixation bores 66 are made in the centers of the tiles. Such bores may be made in any known way such as during the initial molding of tiles, or subsequently such as by the use of a laser or water jet.

The ballistic insert 70 within the network 40, and the second, large screw 90 according to the present invention, provide means for attachment which do not reduce but rather enhance ballistic protection. In addition, the second fixation bores 48 of the network 40 may advantageously be located virtually anywhere desired, allowing for great freedom and convenience in choosing where to place the modules. As an added advantage, the network 40, when attached in the above or similar manner, serves to distance the modules from the chopper floor, thereby minimizing the damage caused to the floor by projectile threats impacting the modules.

The entire assembly, after attachment, may include one or more service modules adapted to be easily removed to provide access to the floor of the chopper and to attachment means therein. By the removal or these service modules, even in mid-flight, appliances, such as passenger seats, may be conveniently attached. Such appliances may also be removed and replaced with service modules as needed with the same relative ease.

The assembly is preferably further provided with a backing layer, shown in FIG. 1 in the form of a carpet 11, to cover the modules on the floor of the chopper. The carpet 11 serves to trap residual fragments of the projectile threat resulting from its impact on the modules M1 and M2 and/or on the network 40. The carpet 11 also traps fragments of the modules M1 and M2 and of the strip portions 52 of the network 40, particularly from the ceramic bodies therein, resulting from the projectile's impact.

The carpet 11 may be attached to the modules on the floor by various means. As shown in FIG. 1, one possibility includes the use of hook and loop fasteners 11*a* and 11*b*, such as Velcro™, which allow for the carpet's easy removal and reattachment and also provide medium attachment strength yielding high ballistic performance. The modules M1 and M2 are provided with loop fasteners 111*b* covering their total top surface area and glued thereto by an adhesive. The carpet 11 is provided with hook fasteners 11*a* sewed and glued by an adhesive to cover the full area of its underside. The carpet 11 is attached to the modules M1 and M2 with the hook and loop fasteners 11*a* and 11*b* in contact to provide a constant and ballistically efficient attachment throughout the assembly. Suitable portions of the carpet 11 and the hook and loop fasteners 11*a* and 11*b* may be cut to cover the service modules and to thereby not hinder their removal or reinstallation.

The network 40 according to the present invention, when used in conjunction with the ballistic carpet 11 and ballistically resistant attachment means such as the kit of the present invention, is capable of providing together with armor modules, near total protection from below the cabin of the chopper by covering the entire floor of the chopper with ballistic protection, thereby leaving no regions, from the perspective of an impacting projectile, allowing the penetration of the projectile.

It should be understood that the above described embodiments are only examples of composite armor structures, ballistic armor attachment kits, and ballistic armor assemblies comprising them in accordance with the present invention, and that the scope of the present invention fully encompasses other embodiments which may become obvious to those skilled in the art.

What is claimed is:

1. A composite armor structure for ballistically protecting a gap in an armor assembly from an impacting projectile threat and for use with at least one ballistic armor module, the gap extending along an edge of the module, the structure comprising a body having a protection portion with at least a single layer of ceramic bodies, and a carrier portion supporting said protection portion and being made of a material different from said ceramic bodies, said protection portion being designed to span the gap and said carrier portion being designed to extend beyond the gap to overlap with said edge of the module, when viewed from a perspective of the impacting projectile threat, wherein the structure is produced from at least a top, a bottom, and an intermediate layer, the intermediate layer being formed with a cut-out defining with the top and bottom layers a closed cavity to carry said ceramic bodies, the top and bottom layers serving to cover the intermediate layer to keep said bodies in place.

2. A composite armor structure according to claim 1, wherein the carrier portion is adapted to provide at least lateral support to said protection portion by being located on at least two sides thereof.

3. A composite armor structure according to claim 1, wherein the carrier portion is made from a metal.

4. A composite armor structure according to claim 1, wherein the carrier portion is made from one of the following: Aluminum alloy, Steel alloy, Titanium alloy, fiberglass, carbon fibers, Nylon, high strength plastic, and composite fibers.

5. A composite armor structure according to claim 1, wherein the protection portion covers at least a majority of an area of said gap exposed to said impacting projectile threat.

6. A composite armor structure according to claim 5, wherein the protection portion extends beyond said area to overlap with the margin of the armor module to provide said margin with ballistic reinforcement.

7. A composite armor structure according to claim 1, wherein the structure is a strip.

8. A composite armor structure according to claim 1, wherein said carrier portion includes attachment means to allow the structure to be attached to a surface.

9. A composite armor structure according to claim 8, wherein said attachment means coincide with existing attachment means for mounting said module to the surface.

10. A composite armor structure according to claim 8, wherein said attachment means are fixation bores.

11. A composite armor structure according to claim 1, wherein said structure is in the form of a network and said body is designed to simultaneously protect a plurality of gaps, the network having a plurality of protection portions, each surrounded by its corresponding carrier portion, different carrier portions being interconnected.

12. A composite armor structure according to claim 11, wherein said network includes at least one integrally formed support member in the form of an extension of said carrier portion to hold the structure together as a unitary construction.

13. A composite armor structure according to claim 11, wherein the structure is provided with a cut-out corresponding to said module to reduce the weight of the network.

14. A composite armor structure according to claim 1, wherein the structure is adapted to be used in a transport vehicle.

15. A composite armor structure according to claim 1, wherein the structure is attached to said module from beneath.

16. A composite armor structure according to claim 1, wherein the bottom layer serving to carry said ceramic bodies.

17. A composite armor structure according to claim 1, wherein said ceramic bodies are in the form of tiles.

18. A composite armor structure according to claim 17, wherein said tiles are substantially rectangular.

19. A composite armor structure according to claim 1, wherein said ceramic bodies are bound to each other by an adhesive material.

20. A ballistic armor assembly for providing protection to a body from an impacting projectile threat, the armor comprising at least one ballistic armor module for the protection of a major area of the body, and further comprising at least one composite armor structure for ballistically protecting a gap in an armor assembly as defined in claim 1, which extends along an edge of said at least one ballistic armor module.

21. A ballistic armor assembly according to claim 20, further including a backing layer for trapping fragments resulting from the impacting projectile threat.

* * * * *